US006382054B1

(12) United States Patent
Kirk

(10) Patent No.: US 6,382,054 B1
(45) Date of Patent: May 7, 2002

(54) SIDEWINDER WRENCH

(76) Inventor: Norbert Kirk, 307 W. Wood Dr., Phoenix, AZ (US) 85029

( * ) Notice: Subject to any disclaimer, the term of this patent is extended or adjusted under 35 U.S.C. 154(b) by 0 days.

(21) Appl. No.: 09/805,061

(22) Filed: Mar. 14, 2001

(51) Int. Cl.[7] ..... B25B 13/06
(52) U.S. Cl. ..... 81/124.4; 81/125.1
(58) Field of Search ..... 81/124.4, 121.1, 81/124.6, 124.3, 125.1

(56) References Cited

U.S. PATENT DOCUMENTS 564,625 A 7/1896 Kelsea
D53,597 S 7/1919 Marcmann
1,930,238 A * 10/1933 Heller ..... 81/124.4
5,086,674 A * 2/1992 Her ..... 81/124.4

* cited by examiner

*Primary Examiner*—D. S. Meislin
(74) *Attorney, Agent, or Firm*—George H. Miller, Jr., Atty.

(57) ABSTRACT

A sidewinder wrench comprising a cylinder with a wall thickness having a polygonal outer surface providing flat surfaces with openings for various sized nuts. The cylinder can be grasped with one hand on one flat surface and the opposite flat surface can be placed over a mating nut and rotated to tighten or loosen the nut. The ends of the cylinder can also receive indented circular plates to provide a variety of openings for additional sized nuts.

6 Claims, 1 Drawing Sheet

SIDEWINDER WRENCH

BACKGROUND OF THE INVENTION

Socket wrenches have been developed over the years in many configurations based upon certain desirable features such as leverage, compactness and variety of applications. It has been common to design wrenches in a single unit to have several openings for different sized nuts.

In 1896, Kelsea was issued U.S. Pat. No. 564,025 on a bicycle wrench comprising a circular plate that had openings for three different sized hexagonal nuts. In use, the plate would be placed with one of the openings over a similarly sized nut and the plate rotated to tighten or loosen the nut.

In application Ser. No. 09/372,363, assigned to the Applicant and incorporated herein by reference, a similar type wrench comprises a cylindrical wall with inner plates mounted on each end of the cylinder. Each plate has a central opening and the edges provide openings for open sockets for various sized nuts. In use, the central opening is placed over a nut, the wrench is slid with the proper opening to enclose the sides of the nut and the cylinder is rotated to tighten or loosen the nut. With the two plates, one on each end of the cylinder, one can have openings sized for nuts gaged in inches and one can have openings sized for nuts gaged in metric.

In 1919, Marcmann was issued U.S. Design Pat. No. 53,597 on a wrench comprising a bar with a globular shape on each end. Each globular shape provides four openings on the periphery of the globe parallel to the axis of the bar and one opening on the top of the globe at each end of the bar. This configuration provides ten different sized openings with advantageous leverage for the eight openings on the periphery of each globular end.

It is an object of the current invention to provide improvements over the above three inventions that result in a compact, easy to use wrench that can be used in a variety of situations.

SUMMARY OF THE INVENTION

This invention will comprise a cylindrical configuration with the openings in the wall of the cylinder rather than in plates on the cylinder ends as in application Ser. No. 09/372,363 cited above.

The cylinder in a preferred embodiment will have at least eight openings (hexagonal, square or other) for eight different sized nuts. The outer cylindrical surface will actually be an octagon so that each of the openings will have a flat surface for engaging the surface surrounding the engaged nut.

DETAILED DESCRIPTION OF THE INVENTION

Figure 1:
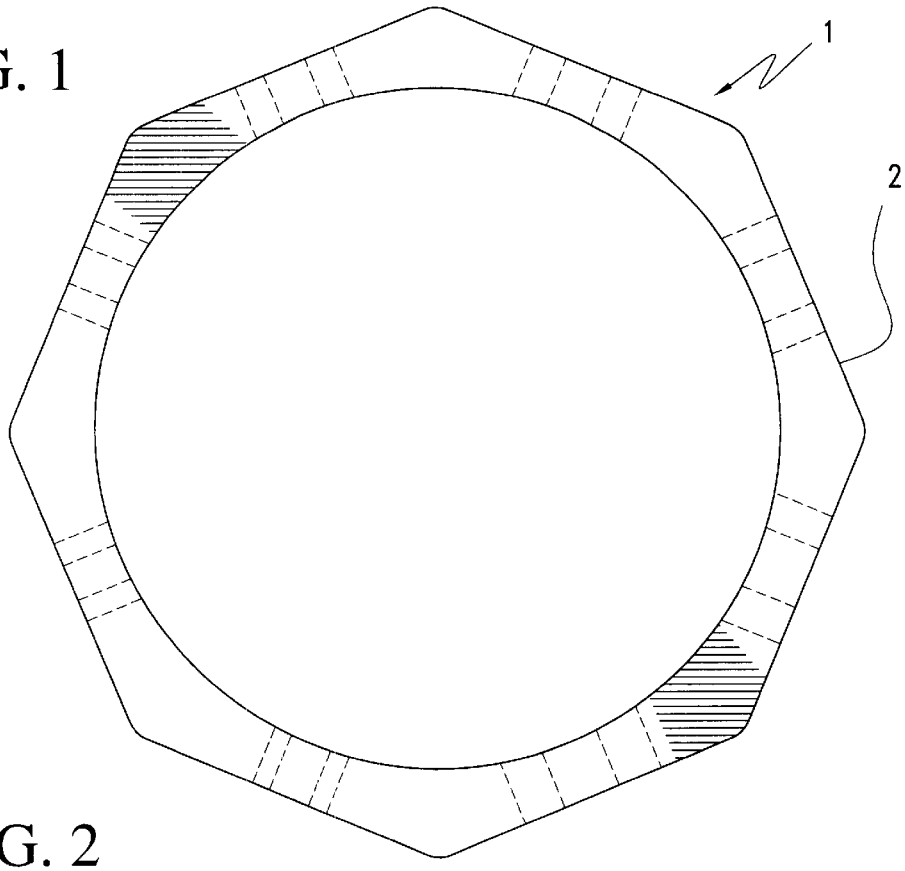
FIG. 1 is a top view of the cylinder with eight flat exterior sides.
Figure 2:
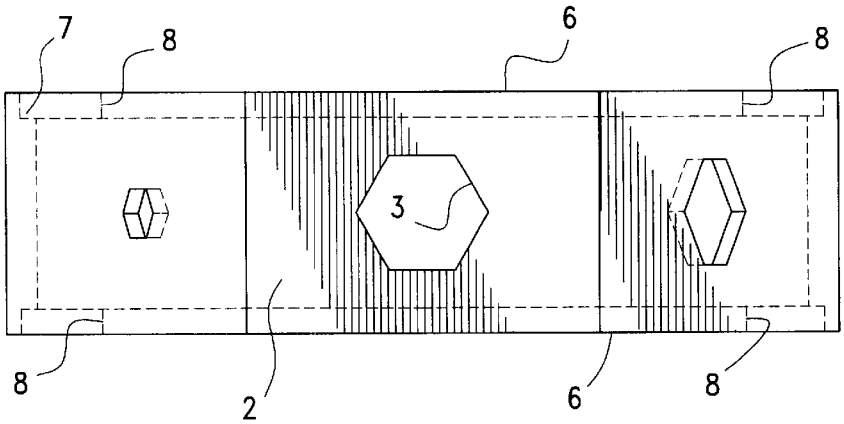
FIG. 2 is a side view of the cylinder with an added feature for a second embodiment.

The sidewinder wrench 1 as shown in FIG. 1 comprises a cylinder 3 to 4 inches in diameter, approximately ½ inch thick and 1 to 1½ inches in length with the outer surface formed with eight flat surfaces 2 resulting in an outer octagonal shape. Each flat surface shall provide at least one opening 3 as shown in FIG. 2 as a hexagonal opening to mate with a similarly sized hexagonal nut. The other seven openings shall provide similar openings for hexagonal nuts of different sizes in inches or metric units.

Figure 3:
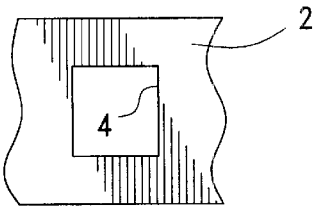
FIG. 3 is a view of an opening for a square nut.

The openings may be configured to be used on square nuts 4 as shown in FIG. 3.

Figure 4:
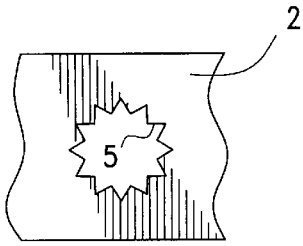
FIG. 4 is a view of a generic multifaceted opening for a nut having sides that may fit against some of the edge corners of the opening.

The openings may be configured to be used on a variety of nuts that can be engaged against the edges of a generic socket as shown in FIG. 4.

In operation, the sidewinder wrench can be grasped in one hand on one of the flat surfaces and the opposite flat surface is pressed against a selectively sized nut and rotation of the wrench by the one hand can tighten or loosen the nut.

One disadvantage of a compact wrench such as the sidewinder wrench as compared with a set of long handled wrenches is a lack of leverage. However, this can be easily overcome by a bar or stick that can be inserted into the cylindrical opening. With the first hand holding the flat surface against the nut, the other hand can apply a force on the bar or stick that is in contact with opposed edges of the cylinder resulting in a torque much stronger than can be applied by the one hand on the periphery of the cylinder.

The sidewinder wrench can be made in a number of ways. The cylinder can be fabricated as a unit from a metal casting as shown in FIG. 1. The cylinder can be fabricated as a unit using injection molding of hard, tough plastic as shown in FIG. 1.

FIG. 2 shows dotted lines parallel to the upper and lower edges. The cylinder as shown in FIG. 1 can be formed with an inner indented circular surface on each end to receive two metal or hard, tough plastic circular plates 6 with openings and laminated to the end surfaces of the cylinder at 7 as shown in FIG. 2. These end plates can also provide inner openings for sockets as shown at 8 and as described above in application Ser. No. 09/372,363.

Other variations such as more than one opening on each flat surface and other obvious modifications are intended to be covered by the following claims.

What is claimed is:

1. A wrench comprising a cylinder having an inner circular surface and having a polygonal outer surface providing flat surfaces, each flat surface providing at least one opening that can be placed over a mating nut.

2. A wrench as in claim 1 in which the opening is hexagonal.

3. A wrench as in claim 1 in which the opening is square.

4. A wrench as in claim 1 in which the opening is multifaceted and can mate with several types of nuts.

5. A wrench as in claim 1 which is formed from a single unit casting of metal.

6. A wrench as in claim 1 which is formed by injection molding of a hard tough plastic.

* * * * *